US006283722B1

(12) United States Patent
Takenaka et al.

(10) Patent No.: US 6,283,722 B1
(45) Date of Patent: Sep. 4, 2001

(54) VARIABLE DISPLACEMENT TYPE COMPRESSOR

(75) Inventors: Kenji Takenaka; Hiroaki Kayukawa; Tetsuhiko Fukanuma; Masahiro Kawaguchi; Hideki Mizutani; Suguru Hirota; Hiroyuki Nakaima, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/539,575

(22) Filed: Mar. 31, 2000

(30) Foreign Application Priority Data

Apr. 2, 1999 (JP) ..... 11-095926
Jun. 8, 1999 (JP) ..... 11-161047

(51) Int. Cl.[7] ..... F04B 1/26
(52) U.S. Cl. ..... 417/222.2; 92/12.2
(58) Field of Search ..... 417/222.1, 222.2; 92/12.2, 71

(56) References Cited

U.S. PATENT DOCUMENTS 5,364,232 * 11/1994 Kimura et al. ..... 417/222.1
5,638,735 * 6/1997 Ota et al. ..... 92/12.2
6,044,751 * 4/2000 Kimura et al. ..... 92/71
6,077,047 * 6/2000 Nagai et al. ..... 417/222.1
6,116,145 * 9/2000 Ota et al. ..... 92/12.2
6,146,107 * 11/2000 Kawaguchi et al. ..... 417/222.2
6,186,048 * 2/2001 Kimura et al. ..... 92/71

FOREIGN PATENT DOCUMENTS 0 814 263 A2 12/1997 (EP) ..... F04B/27/18
5149244 * 6/1993 (JP) ..... F04B/27/08
6-288347 10/1994 (JP) .
9112420 * 5/1997 (JP) ..... F04B/27/14
9-203377 8/1997 (JP) .
10-054353 2/1998 (JP) .

* cited by examiner

*Primary Examiner*—Teresa Walberg
*Assistant Examiner*—Leonid Fastovsky
(74) *Attorney, Agent, or Firm*—Morgan & Finnegan, LLP

(57) ABSTRACT

A variable displacement type swash plate compressor that prevents a drive shaft from moving axially when the difference between a crank chamber pressure and a cylinder bore pressure becomes excessive. A hinge mechanism has a support arm extending from a lug plate and a guide pin extends from a swash plate. The head portion of the guide pin fits in a guide hole formed in the support arm. A cutaway surface is formed in a part of the support arm that defines the guide hole. The cutaway surface forms a clearance in the hinge. The clearance permits the swash plate to move without pulling the drive shaft.

16 Claims, 12 Drawing Sheets

VARIABLE DISPLACEMENT TYPE COMPRESSOR

BACKGROUND OF THE INVENTION

The present invention relates to a variable displacement type compressor that has a coupling mechanism for coupling a cam plate, which drives pistons, to a drive shaft and changes the reciprocation stroke of the pistons by altering the inclination angle of the cam plate by controlling the pressure in a crank chamber.

FIG. 15 shows one type of a variable displacement type compressor for use in a vehicle air-conditioning system. Accommodated in a housing 101 of the compressor are a crank chamber 102, a suction chamber 108, a discharge chamber 109 and a plurality of cylinder bores 107 (only one shown). A piston 110 is retained in each cylinder bore 107. A drive shaft 103 and a lug plate 104, which are fixed to each other, are located in the crank chamber 102. To seal the crank chamber 102, the housing 101 is provided with a lip seal 114 around the front end of the drive shaft 103. The front end of the drive shaft 103 is coupled to the engine (external drive source) of the vehicle directly or indirectly. A spring 112 for urging the drive shaft 103 in a forward direction is located at the rear end of the drive shaft 103. The spring 112 positions the drive shaft 103 and the lug plate 104 in the crank chamber 102 in the axial direction while absorbing the tolerances of the drive shaft 103 and various components associated with the drive shaft 103.

Provided around the drive shaft 103 is a swash plate 105, or cam plate. The swash plate 105, which is coupled to the individual pistons 110 via shoes 113, converts the rotational motion of the drive shaft 103 to reciprocal motion of each piston 110. This swash plate 105 is coupled to the lug plate (rotary support) 104 via a coupling mechanism 115. The coupling mechanism 115 has guide pins 116 protruding from the front face of the swash plate 105 and support arms 117 protruding from the rear face of the lug plate 104. The head of each guide pin 116 is inserted into a cylindrical guide hole 117*a* formed in the associated support arm 117. This coupling mechanism 115 allows the swash plate 105 to rotate with the drive shaft 103 and to tilt as the swash plate 105 moves along the drive shaft 103 (in the axial direction).

The stroke of the pistons 110, or the discharge displacement, is determined by the inclination angle of the swash plate 105, which is mainly determined by the difference between the pressure of the crank chamber 102 (crank pressure Pc) and the pressure in the cylinder bores 107 via the associated piston 110. This difference is controlled by a displacement control valve 120. Generally speaking, as the crank pressure Pc rises, the swash plate 105 disinclines, or slides on the drive shaft 103 away from the lug plate 104, making the inclination angle of the swash plate 105 smaller. A restriction ring 106 is fixed on the drive shaft 103 so that, when the swash plate 105 contacts the restriction ring 106, further disinclination of the swash plate 105 is restricted, thereby defining the minimum inclination angle of the swash plate 105. In the compressor in FIG. 15, the control mechanism for the crank pressure Pc comprises a restriction-equipped bleed passage 118, which connects the crank chamber 102 to the suction chamber 108, an supply passage 119, which connects the discharge chamber 109 to the crank chamber 102, and the displacement control valve 120 located midway in the supply passage 119. The opening of this displacement control valve 120 can be adjusted by external energization. As the opening of this control valve 120 is adjusted externally, the amount of high-pressure refrigerant gas supplied into the crank chamber 102 from the discharge chamber 109 via the supply passage 119 is adjusted. The crank pressure Pc is determined by the relationship between the flow rate of gas supplied to the crank chamber 102 and the flow rate of gas that is released from the crank chamber 102 via the bleed passage 118.

In the air-conditioning system of a vehicle, the capacity of the compressor is minimized to reduce the engine load as much as possible when rapidly accelerating the vehicle. When the air-conditioning system is switched off or the engine is stopped, the discharge capacity of the compressor is often minimized in advance to prevent the next activation of the compressor from applying an excess load to the engine. As far as the compressor in FIG. 15 is concerned, the capacity of the compressor is minimized by supplying high-pressure refrigerant gas into the crank chamber 102 from the discharge chamber 109 with the displacement control valve fully opened by an external signal. To minimize the capacity of the compressor when rapidly accelerating the vehicle, particularly, it is necessary to quickly minimize the discharge capacity. Thus, high-pressure refrigerant gas is often rapidly led into the crank chamber 102.

When high-pressure gas in the discharge chamber 109 is led into the crank chamber 102 to swiftly increase the crank pressure Pc, however, various problems may arise depending on the amount of the pressure rise. Anything serious may not occur until the sudden rise of the crank pressure Pc minimizes the inclination angle of the swash plate 105. If the difference between the crank pressure and the cylinder-bore inner pressure is too large even after the inclination angle of the swash plate 105 is minimized, the excess pressure difference causes the pistons 110 to move rearward (in the direction away from the lug plate). This applies a rearward force to the swash plate 105. At this time, the inclination angle of the swash plate 105 is minimized and the swash plate 105 abuts against the restriction ring 106. When the rearward force acts on the swash plate 105, therefore, the swash plate 105 urges the drive shaft 103 against the force of the spring 112 via the restriction ring 106. Further, the swash plate 105 is coupled to the lug plate 104 by the engagement of each guide pin 116 and the associated guide hole 117*a* of the coupling mechanism 115. If the swash plate 105 is rapidly disinclined, the swash plate 105 pulls the lug plate 104 and the drive shaft 103 rearward against the force of the spring 112. In other words, when the crank pressure becomes too large, a strong rearward force acts on the entire inner mechanism of the compressor which includes the pistons, the swash plate, the coupling mechanism, the lug plate and the drive shaft, causing those components to move rearward beyond the design limit for such movement(i.e., the axial position corresponding to the minimum inclination angle of the swash plate 105). This brings about the following problems.

Problem 1: When the drive shaft 103 moves rearward beyond the design limit, the position of contact between the lip seal 114 and the drive shaft 103 changes from a predetermined position called the contact line. Foreign matter such as sludge adheres to the outer surface of the drive shaft 103 at locations other than the contact line. If the drive shaft 103 moves axially, therefore, foreign matter may come between the outer surface of the drive shaft 103 and the lip seal 114, which will break the seal produced by the lip seal 114.

Problem 2: In some compressors of vehicles, an electromagnetic clutch is located in the power transmitting path between the engine and the drive shaft 103. The typical electromagnetic clutch has a drive clutch plate on the engine side and a driven clutch plate (armature), which rotates with the drive shaft 103 and can be shifted axially by the force of a spring. The clutch is engaged by electromagnetically engaging the armature and the drive clutch plate when the electric power is cut off, a predetermined gap should exist between the armature and the drive clutch plate. When the engine is stopped, in the air-conditioning system, the electromagnetic clutch is deactivated and the displacement control valve 120 is fully opened. As the displacement control valve 120 is fully open, as mentioned above, the drive shaft 103 moves further rearward beyond the design limit. Despite the power cutoff, therefore, the armature together with the drive shaft 103 approaches the drive clutch plate from the original separated position so that the predetermined gap between both clutch plates may not be secured at all. That is, in spite of the attempted power cutoff action, the armature and the drive clutch plate have a slide contact with each other. This slide contact not only disables the power cutoff but also brings about a new problem of producing noise or heat or wearing the clutch plates.

SUMMARY OF THE INVENTION

Accordingly, it is an object of the present invention to provide a variable displacement type compressor which prevents the drive shaft from being pulled rearward by the swash plate (cam plate) coupled to the pistons and moving rearward over the design limit in the axial direction even when the difference between the crank pressure and the inner pressure of each cylinder bore via the associated piston is excessively large as a result of the rapid rise in crank pressure in a short period of time due to an internal or external factor.

To achieve this object, in accordance with the present invention, there is provided a variable displacement type compressor comprising: a crank chamber; a drive shaft rotatably supported in the crank chamber; pistons for performing a compressing operation; a cam plate, located in the crank chamber and coupled to the pistons for converting rotation of drive shaft to a reciprocal motion of the pistons, the stroke of which depends on the inclination angle of said cam plate, which varies according to the pressure in said crank chamber; and a coupling mechanism for coupling the cam plate to the drive shaft, the coupling mechanism including: a rotary support that rotates integrally with the drive shaft; a first engaging surface provided on the rotary support; and a second engaging surface provided on the cam plate, wherein the first engaging surface and the second engaging surface engage and couple the cam plate to the rotary support to permit said inclination of the cam plate with respect to said drive shaft, wherein at least one of the first engaging surface and the second engaging surface has a predetermined shape that causes the first engaging surface to separate and disengage from the second engaging surface when the inclination angle of said cam plate is at or near a minimum.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

With reference to FIGS. 1 through 5, a description will be given of one embodiment of the present invention which is included in a variable displacement type swash plate compressor used in a vehicle air-conditioning system.

Figure 1:
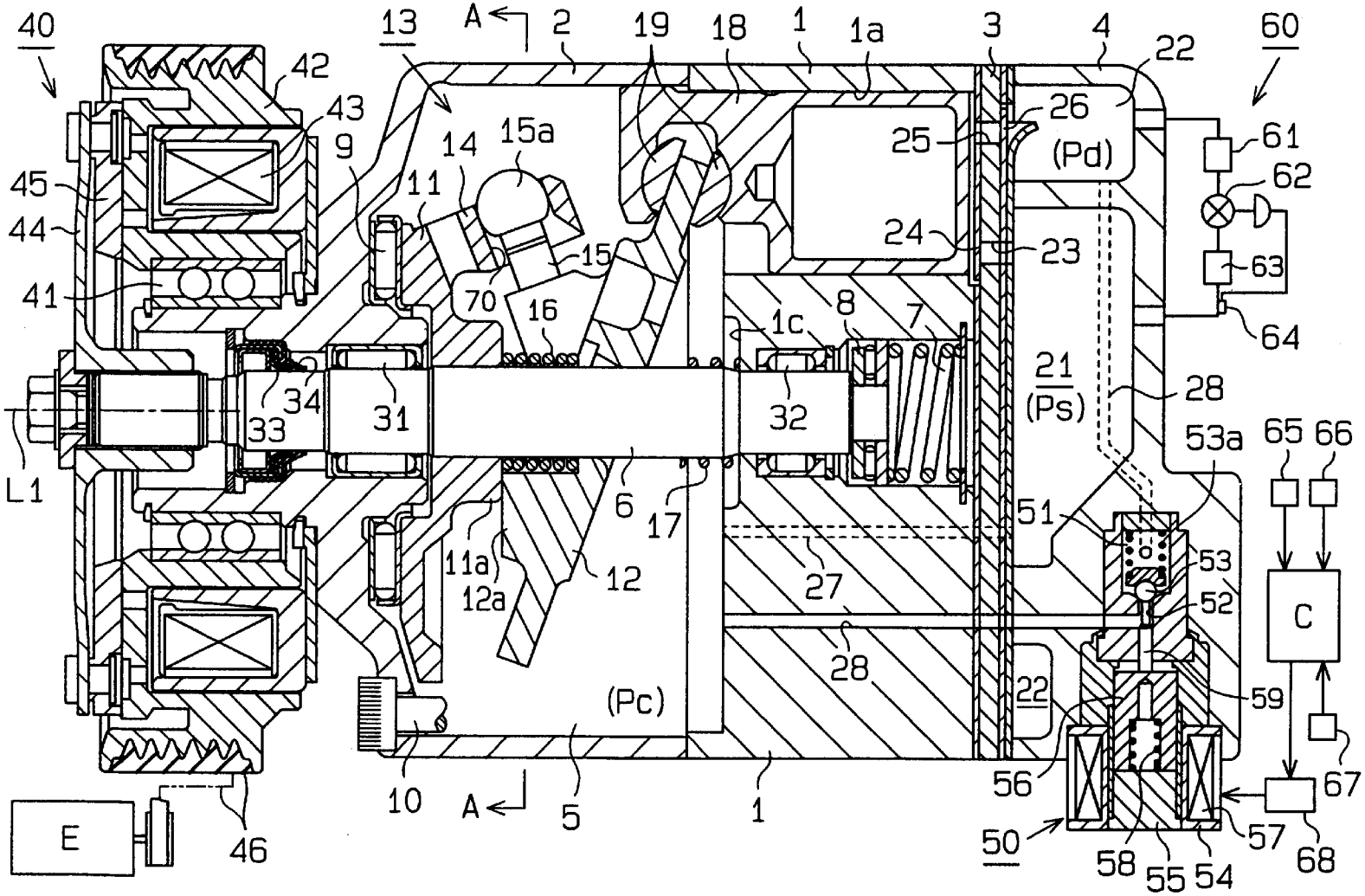
FIG. 1 is a longitudinal cross-sectional view of a variable displacement type swash plate compressor according to one embodiment of this invention when the inclination angle of a swash plate is a maximized.

As shown in FIG. 1, the variable displacement type swash plate compressor includes a cylinder block 1, a front housing 2 which is connected to the front end of the cylinder block 1, and a rear housing 4 which is connected through a valve plate 3 to the rear end of the cylinder block 1. The cylinder block 1, front housing 2, valve plate 3 and rear housing 4 are securely joined by a plurality of bolts 10 (see FIG. 5) to form compressor housing.

As shown in FIG. 1, a crank chamber 5 is defined by the cylinder block 1 and the front housing 2. A drive shaft 6 is located in the crank chamber 5 and is supported front and rear radial bearings 31 and 32, which are respectively provided in the front housing 2 and the cylinder block 1. Provided in a recess formed in the center of the cylinder block 1 are a first coil spring 7, which urges the drive shaft 6 forward, and a rear thrust bearing 8. A lug plate 11, or rotary support, is fixed to the drive shaft 6. A front thrust bearing 9 is located between the lug plate 11 and the inner wall of the front housing 2. The drive shaft 6 and lug plate 11 are axially positioned by the rear thrust bearing 8, which is urged in a forward direction by the first coil spring 7, and the front thrust bearing 9.

The front end of the drive shaft 6 protrudes from the front portion of the front housing 2. A lip seal 33 is located between the outer surface of the drive shaft 6 and the inner surface of the front portion of the front housing 2. The lip seal 33 has a lip ring 34 which firmly contacts the outer surface of the drive shaft 6, thereby sealing the front of the drive shaft 6 to hermetically seal the crank chamber 5.

The front end of the drive shaft 6 is coupled to a vehicular engine E as an external drive source through an electromagnetic clutch 40. The electromagnetic clutch 40 has a pulley 42, a ring-like solenoid coil 43, a hub 44 which is made of an elastic member, and an armature 45. The pulley 42 is supported on the front cylindrical portion of the front housing 2 by a bearing 41. The hub 44 is secured to the front end of the drive shaft 6. FIG. 1 shows the armature 45 engaged with the end face of the pulley 42 against the forward elastic force of the hub 44. The end face of the pulley 42 and the armature 45 serve as a pair of clutch plates, which can engage and separate from each other. When the electromagnetic force generated by the excitation of the coil 43 causes the armature 45 to be attracted to and engaged with the end face of the pulley 42, the driving power of the engine E is transmitted to the drive shaft 6 through a power transmission belt 46, the pulley 42, the armature 45 and the hub 44. When the electromagnetic force disappears as the coil 43 is deexcited, the armature 45 moves away from the pulley 42 by the elastic force of the hub 44, thus discontinuing power transmission. The engine power is therefore selectively transmitted to the drive shaft 6 by controlling the excitation of the coil 43 of the electromagnetic clutch 40.

A cam plate, which is a swash plate 12 in this embodiment, is accommodated in the crank chamber 5. The drive shaft 6 passes through a hole formed in the center of the swash plate 12. The swash plate 12 is coupled to the lug plate 11 and the drive shaft 6 through a hinge mechanism 13. The hinge mechanism 13 includes two support arms 14 (holding members), which protrude from the rear face of the lug plate 11, and two guide pins 15 (inserting members), which protrude from the front face of the swash plate 12 (see FIGS. 1 and 5). The hinge mechanism 13 and the lug plate 11 form a coupling mechanism, which will be discussed later in detail. The linkage of the support arms 14 and the guide pins 15 and the contact of the swash plate 12 with the drive shaft 6 causes the swash plate 12 to rotate with the lug plate 11 and the drive shaft 6 and allows the swash plate 12 to tilt with respect to the axis L1 of drive shaft 6 as the swash plate 12 slides along the drive shaft 6. The swash plate 12 has a counter weight 12*a* located opposite to the hinge mechanism 13.

Figure 2:
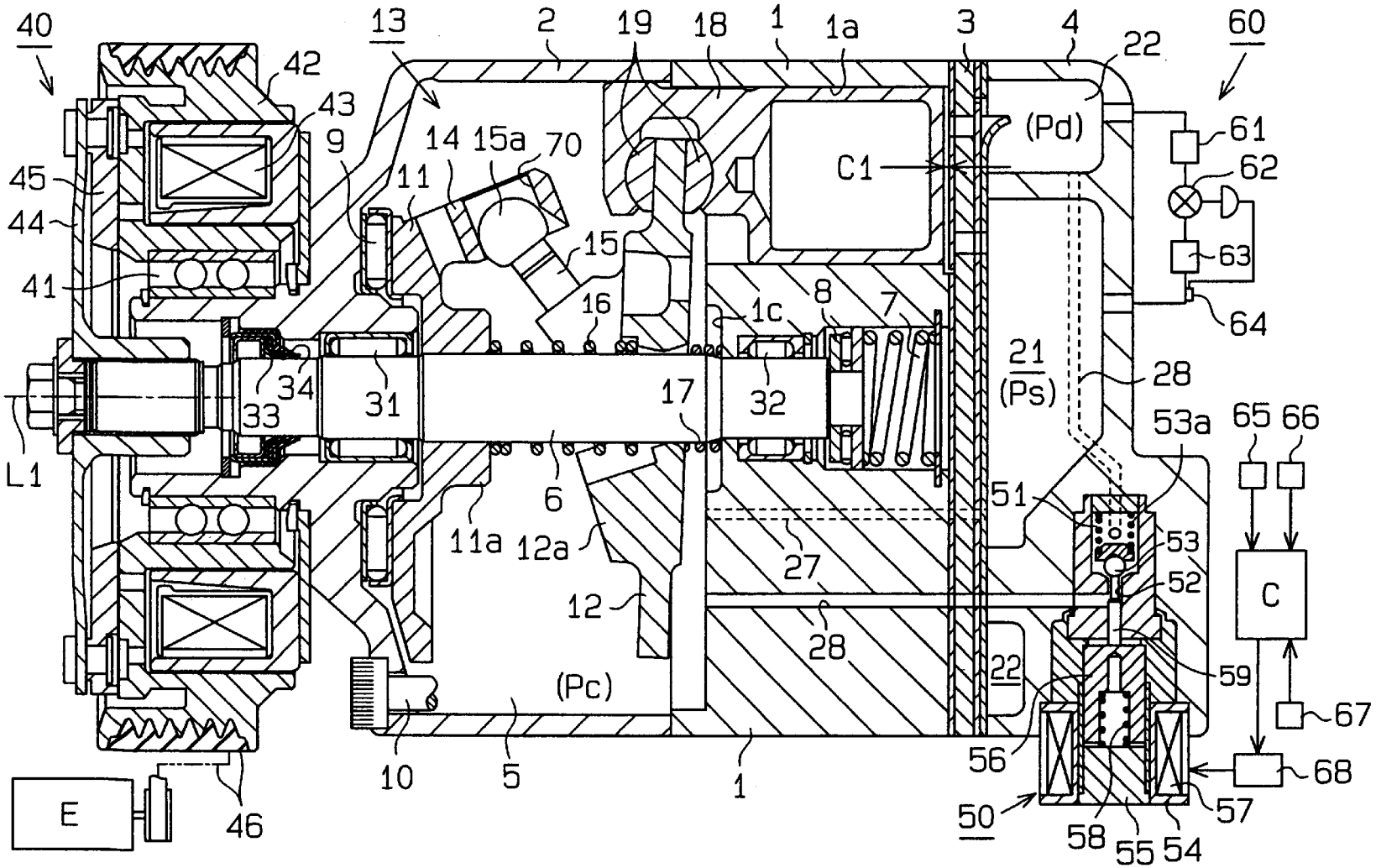
FIG. 2 is a longitudinal cross-sectional view of the variable displacement type swash plate compressor when the inclination angle of the swash plate is a minimized.

As shown in FIGS. 1 and 2, a second coil spring 16 for reducing the inclination angle of the swash plate 12 is provided on the drive shaft 6 between the lug plate 11 and the swash plate 12. The coil spring 16 urges the swash plate 12 toward the cylinder block 1 (i.e., in a direction reducing the inclination angle of the swash plate 12). A third coil spring 17, or return spring, is provided on the drive shaft 6 behind the swash plate 12, or between the swash plate 12 and the front end face 1*c* of the cylinder block 1 (the face of the cylinder block 1 on the crank chamber side). When the inclination angle of the swash plate 12 is large, as shown in FIG. 1, the third coil spring 17 is simply wound around the drive shaft 6 and does not apply force to the swash plate 12 or any other member and is movable along the drive shaft 6 while keeping its natural length. When the inclination angle of the swash plate 12 becomes smaller as shown in FIG. 2, on the other hand, the third coil spring 17 is compressed between the swash plate 12 and the front end face 1*c* of the cylinder block 1, and urges the swash plate 12 away from the cylinder block 1 (i.e., in the direction increasing the inclination angle of the swash plate 12) in accordance with the degree of compression of the coil with the front end face 1*c* serving as a support seat. It is to be noted that the natural length of the third coil spring 17 and the axial position of the front end face 1*c* are set so that the third coil spring (return spring) 17 is not compressed all the way even when the swash plate 12 reaches the designed minimum inclination angle θmin (ranging between 1 to 5°) when the compressor is in operation.

As shown in FIGS. 1 and 2, a plurality of cylinder bores 1*a* (only one shown) are formed in the cylinder block 1 to surround the drive shaft 6. The rear end of each cylinder bore 1*a* is closed by the valve plate 3. A single-headed piston 18 is retained in each cylinder bore 1*a*. Defined in each cylinder bore 1*a* is a compression chamber, the volume of which changes in accordance with the reciprocation of the associated piston 18. The front end of each piston 18 is connected to the periphery of the swash plate 12 via a pair of shoes 19, so that the pistons 18 can be driven by the swash plate 12. When the swash plate 12 and the drive shaft 6 rotate, therefore, the rotational motion of the swash plate 12 is converted to linear reciprocating motion of the pistons 18, and the stroke corresponds to the inclination angle θ of the swash plate 12. The use of the above-described hinge mechanism 13 keeps the top dead centers of the pistons 18 approximately constant. This allows the top clearance C1 (see FIG. 2) to be kept at a desired value. To prevent the piston 18 from continuously striking the valve plate 3 while the compressor is in operation and to maximize the compression efficiency of the compressor, the top clearance C1 is not set to zero but is a very small value.

Defined between the valve plate 3 and the rear housing 4 are a suction chamber 21 and a discharge chamber 22, which surrounds the suction chamber 21 as shown in FIG. 1. The valve plate 3 is a lamination of a suction-valve forming plate, a port forming plate, a discharge-valve forming plate and a retainer forming plate. A suction port 23, a suction valve 24 for opening and closing the suction port 23, a discharge port 25, and a discharge valve 26 for opening and closing the discharge port 25 are formed in the valve plate 3 in association with each cylinder bore 1*a*. The suction chamber 21 is connected to the individual cylinder bores 1*a* through the suction port 23, and the discharge chamber 22 is connected to the individual cylinder bores 1*a* through the discharge port 25. As each piston 18 moves toward the bottom dead center from the top dead center, refrigerant gas in the suction chamber 21 (the area of the suction pressure Ps) is drawn into the associated cylinder bore 1*a* via the suction port 23 and suction valve 24. As the piston 18 moves toward the top dead center from the bottom dead center, the refrigerant gas supplied into the cylinder bore 1*a* is compressed to a predetermined pressure and is discharged into the discharge chamber 22 (the area of the discharge pressure Pd) via the discharge port 25 and discharge valve 26.

In the compressor in FIGS. 1 and 2, when the drive shaft 6 is rotated by the engine E, the swash plate 12, which is inclined at a predetermined angle θ, rotates accordingly. As a result, the individual pistons 18 reciprocate with a stroke corresponding to the inclination angle θ of the swash plate 12, which causes the sequence of suction, compression and discharge of the refrigerant gas to be repeated in each cylinder bore 1*a*.

The inclination angle θ of the swash plate 12 is determined based on the balance of various moments, such as a rotational moment caused by centrifugal force during rotation of the swash plate 12, a moment caused by the urging force of the spring 16 (and the return spring 17), which decreases the inclination angle of the swash plate 12, a moment caused by the reciprocal force of inertia of the pistons 18, and a moment caused by the gas pressure. The gas-pressure moment is generated based on the relationship between the cylinder-bore inner pressure and the inner pressure of the crank chamber 5 (crank pressure Pc), which is known as the piston back pressure, and acts both in the direction of reducing the inclination angle of the swash plate 12 and in the direction of increasing it depending on the crank pressure Pc. The compressor in FIG. 1 is designed to be able to vary the inclination angle θ of the swash plate 12 to any angle between the minimum inclination angle θmin and a maximum inclination angle θmax, (θmin≦θ≦θmax) by properly changing the gas-pressure moment, which is done by adjusting the crank pressure Pc with a displacement control valve 50 (discussed later). The inclination angle θ of the swash plate 12 is the angle defined by the swash plate 12 and an imaginary plane perpendicular to the axis L1 of the drive shaft 6.

The maximum inclination angle θmax of the swash plate 12 is in effect when the counter weight 12*a* of the swash plate 12 abuts against a restriction portion 11*a* of the lug plate 11 (see FIG. 1). The minimum inclination angle θmin of the swash plate 12 is determined mainly by the urging force of the second spring 16, the urging force of the return spring 17 and the gas-pressure moment, which is nearly maximized in the direction of reducing the inclination angle of the swash plate 12. Unlike the maximum inclination angle θmax, the minimum inclination angle θmin is not determined by a mechanical stop. However, it has been confirmed through experiments that the inclination angle θmin is an angle around zero. Therefore, while it is not possible to fit a constant minimum inclination angle θmin, the discharge capacity of the compressor is reduced sufficiently at the minimum inclination angle just as if the minimum inclination angle were determined by a mechanical stop.

The crank pressure Pc, which greatly affects the inclination angle of the swash plate 12, is controlled by a bleed passage 27, an supply passage 28 and the displacement control valve 50, all of which are in the housing of the compressor, as shown in FIGS. 1 and 2. The bleed passage 27 connects the suction chamber 21 to the crank chamber 5, and the supply passage 28 connects the discharge chamber 22 to the crank chamber 5. The displacement control valve 50 is in the supply passage 28. Adjusting the position of the control valve 50 regulates the flow rate of high-pressure gas supplied to the crank chamber 5 via the supply passage 28 with respect to the flow rate of gas released from the crank chamber 5 via the bleed passage 27. The crank pressure Pc is determined accordingly. As the crank pressure Pc changes, the difference between the crank pressure Pc and the inner pressure of the cylinder bore 1*a* is changed. This alters the inclination angle of the swash plate 12, which adjust the piston stroke, or the discharge displacement.

The displacement control valve 50 has a valve chamber 51, a valve hole 52, a spherical valve body 53, and a spring 53*a*, which urges the valve body 53 in a direction to close the valve hole 52. The valve chamber 51 and the valve hole 52 form part of the supply passage 28. The control valve 50 further includes a solenoid 54, which includes a fixed core 55, a movable core 56, a coil 57, which extends about both cores, and a spring 58, which opens the valve hole 52. The movable core 56 and the valve body 53 are connected by a rod 59. The spring 58 urges the valve body 53 via the movable core 56 and the rod 59 in a direction to open the valve hole 52. When the solenoid 54 is excited by a current supplied to the coil 57, electromagnetic attraction is produced between the cores 55 and 56. This attraction force moves the movable core 56 downward against the force of the spring 58, which causes the valve body 53 to close the valve hole 52 with the help of the spring 53*a*. When the current supplied to the coil 57 is stopped to deexcite the solenoid 54, the electromagnetic attraction between the cores 55 and 56 disappears. As a result, the force of the spring 58, which is stronger than that of the spring 53*a*, moves the valve body 53 upward via the movable core 56 and the rod 58, thereby opening the valve hole 52.

The suction chamber 21 and the discharge chamber 22 of the compressor shown in, for example, FIG. 1 are connected through an external refrigeration circuit 60. The external refrigeration circuit 60 and the compressor form a cooling circuit of a vehicle air-conditioning system. The external refrigeration circuit 60 includes a condenser 61, a temperature-sensitive expansion valve 62 and an evaporator 63. The angle of the expansion valve 62 is feedback controlled based on the temperature detected by a temperature sensing cylinder 64 provided at the outlet side of the evaporator 63 and the evaporation pressure (specifically, the pressure at the outlet of the evaporator). The expansion valve 62 allows an amount of refrigerant that matches the thermal load to be supplied to the evaporator 63, thereby regulating the flow rate of the refrigerant gas in the external refrigeration circuit 60.

The air-conditioning system has a computer C, which performs general control of the air-conditioning system. Connected to the input side of the computer C are, for example, a temperature sensor 65 for detecting the temperature inside the passenger compartment, a temperature setting unit 66 for allowing a passenger to set the temperature inside the passenger compartment, and an engine speed sensor 67 for detecting the rotational speed of the engine E of the vehicle. The output side of the computer C is connected via a drive circuit 68 to the coil 57 of the control valve 50. The computer C computes the level of the current to be supplied to the coil 57 based on external information, such as the temperature of the passenger compartment from the temperature sensor 65, the temperature set by the temperature setting unit 66 and the engine speed detected by the engine speed sensor 67 and supplies the current to the coil 57 via the drive circuit 68 in accordance with the result of the computation.

When the temperature of the passenger compartment is higher than the set temperature, the solenoid 54 is excited and the valve body 53 shifts in the direction to close the valve hole 52, thereby reducing the opening size of the supply passage 28. Consequently, the crank pressure Pc falls, making the difference between the crank pressure and the cylinder-bore inner pressure via the piston 18 smaller. This causes the swash plate 12 to tilt toward the maximum inclination angle, which increases the discharge displacement. When the temperature of the passenger compartment is close to the set temperature, on the other hand, the solenoid 54 is deexcited and the valve body 53 shifts in the direction to increase opening size of the valve hole 52. This increases the opening size of the supply passage 28. As a result, the crank pressure Pc tends to rise, which increases the difference between the crank pressure and the cylinder-bore pressure. This causes the swash plate 12 to tilt toward the minimum inclination angle, which decreases the discharge displacement.

The coupling mechanism, which is the characterizing component of this invention, will now be discussed.

Figure 3:
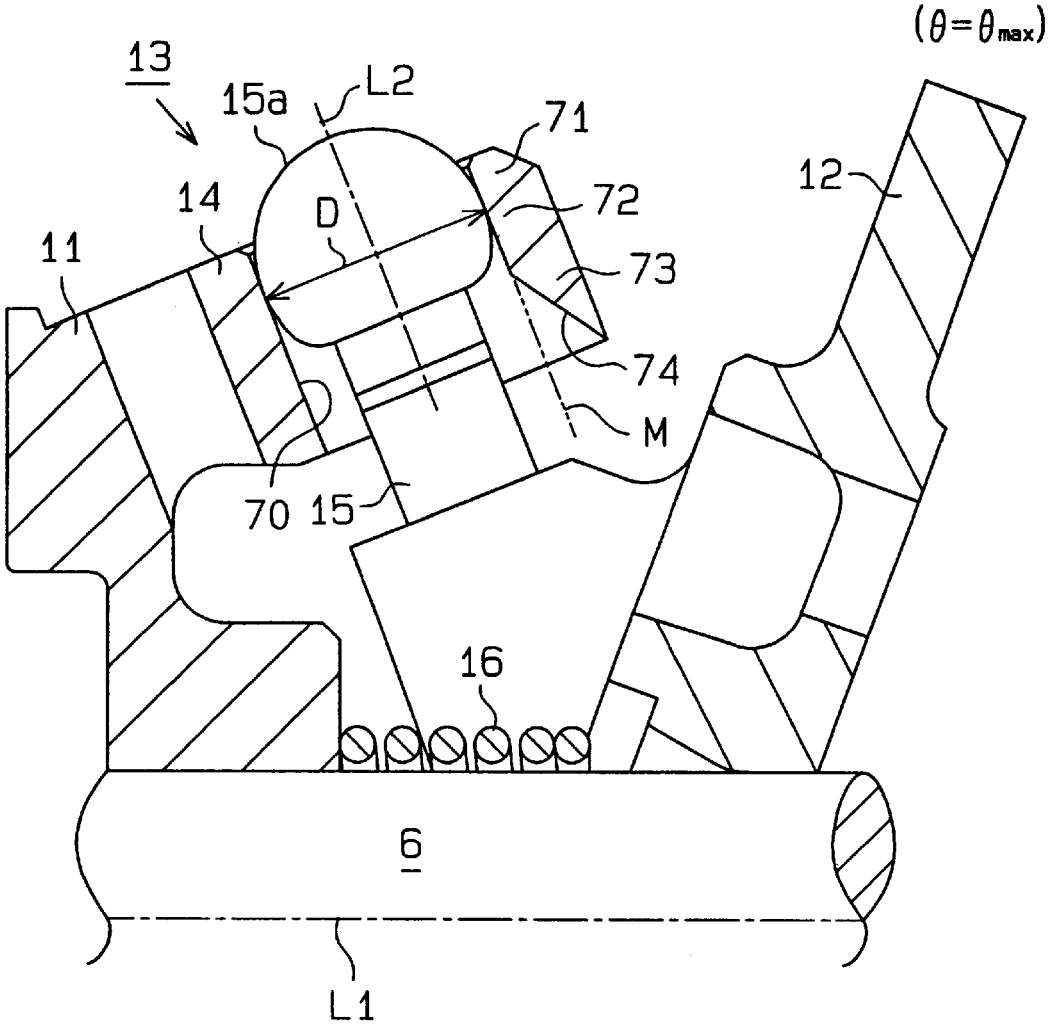
FIG. 3 is an enlarged cross-sectional view showing the state of a coupling mechanism when the inclination angle of the swash plate is a maximized.
Figure 4:
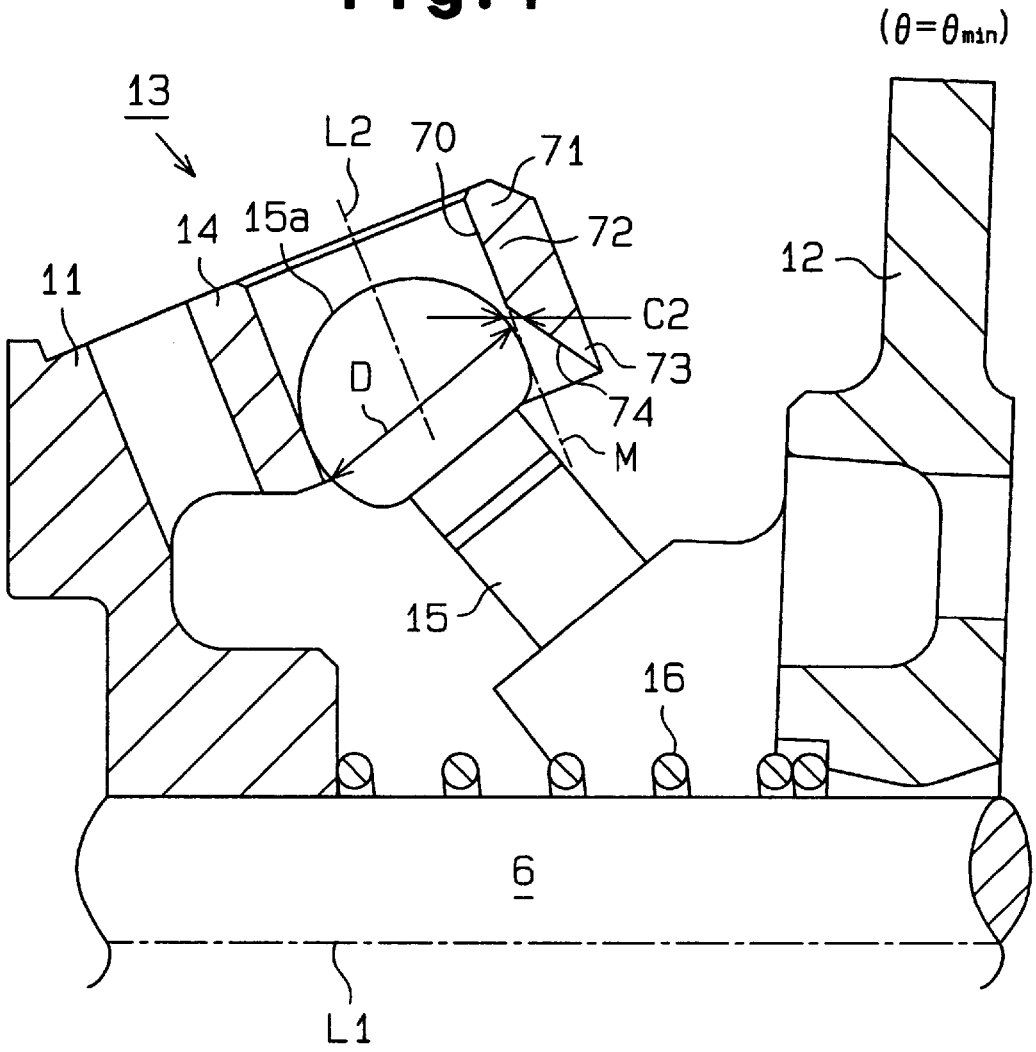
FIG. 4 is an enlarged cross-sectional view showing the state of the coupling mechanism when the inclination angle of the swash plate is a minimized.
Figure 5:
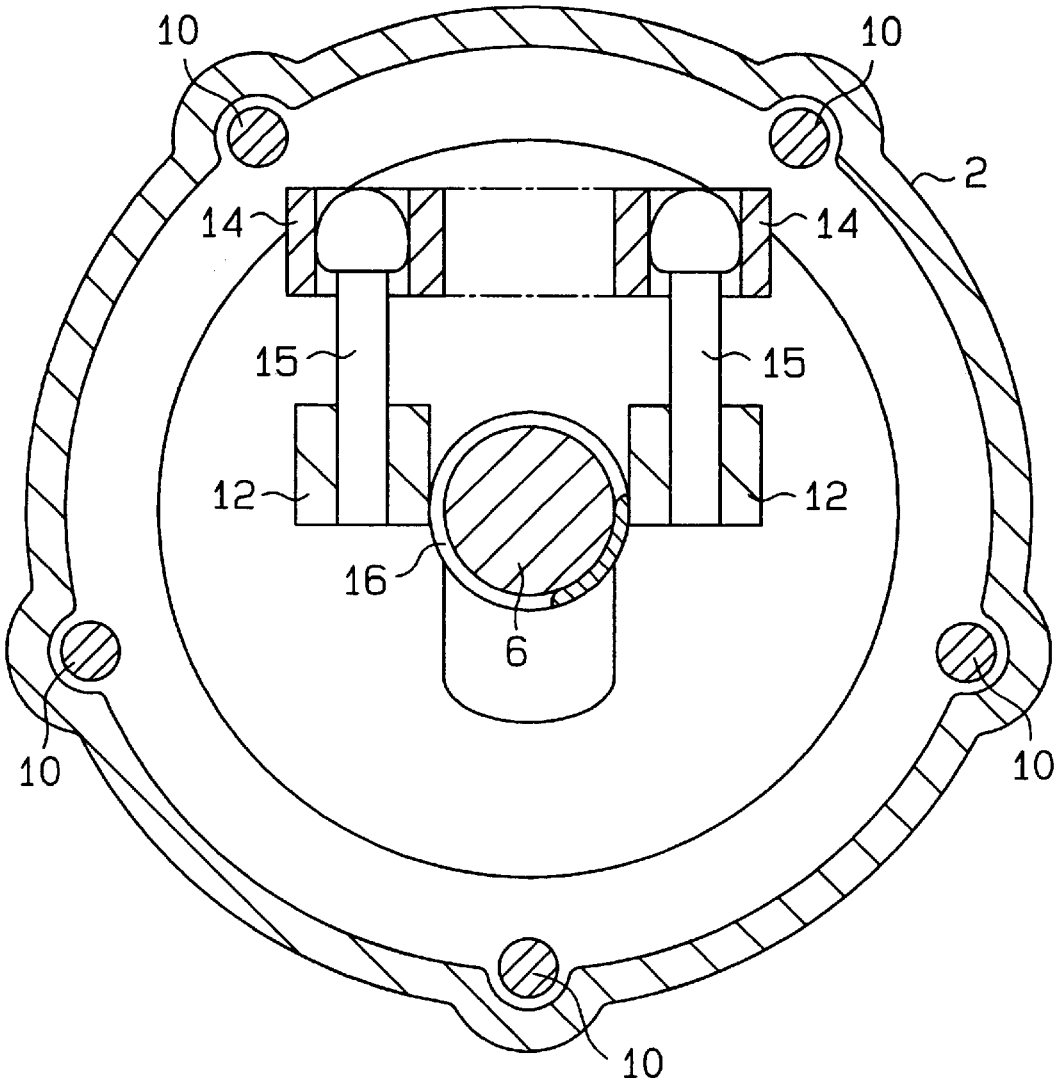
FIG. 5 is a schematic transverse cross-sectional view of the variable displacement type swash plate compressor along the line A—A in FIG. 1.

As shown in FIGS. 1, 2 and 5, the coupling mechanism includes the lug plate (rotary support) 11 and the hinge mechanism 13. As mentioned earlier, the hinge mechanism 13 includes the two support arms 14 and the two guide pins 15. Referring to FIG. 5, the right and left guide pins 15 are associated with the respective two support arms 14. A set of one support arm 14 and one guide pin 15 forms the smallest essential mechanism. FIGS. 3 and 4 show one set of the support arm 14 and the guide pin 15. FIG. 3 shows the support arm 14 engaged with the associated guide pin 15 when the swash plate 12 is at the maximum inclination angle θmax, and FIG. 4 shows the condition when the swash plate 12 is at the minimum inclination angle θmin.

As shown in FIGS. 3 and 4, each guide pin 15 obliquely extends upward and forward from the front face of the swash plate 12. An approximately spherical head portion 15*a* is formed at the distal end of each guide pin 15. An annular socket is provided at the distal end of each support arm 14. A cylindrical guide hole 70 is formed inside each socket. The head portion 15*a* of each guide pin 15 is fitted into the corresponding guide hole 70 and is guided by the wall of the hole 70. The guide hole 70 may be a recess instead of a hole. The axis L2 of the guide hole 70 approximately coincides with the axis of the guide pin 15 in FIG. 3. The thickness of the annular wall of the support arm 14 that defines the cylindrical guide hole 70 varies in the direction of the axial line L2.

This point will be discussed more specifically. First, the portion of the annular wall on the rear side of the axis L2 is divided into an upper portion 71, a middle portion 72 and a lower portion 73. The upper portion 71 and the middle portion 72 of the support arm 14 are formed in such a way that the inside diameter of the guide hole 70 is nearly equal to the maximum diameter D of the head portion 15*a* of the guide pin 15. That is, when the head portion 15*a* of the guide pin 15 is in the upper area or middle area of the guide hole 70 (i.e., when the swash plate 12 is inclined at the maximum inclination angle or at an intermediate angle between the maximum inclination angle and the minimum inclination angle), nearly the entire circumference of the head portion 15*a* contacts the inner surface of the socket. As apparent from the above, in the upper and middle portions of the guide hole 70, the guide pin 15 is securely held while sliding motion and rocking motion are permitted in accordance with changes in the inclination angle of the swash plate 12.

The lower portion 73 of the support arm 14 is cut away and is thus thinner than the upper portion 71 and the middle portion 72. An imaginary line M indicates the location of the wall of the guide hole 70, and an angled surface 74 is formed on the lower portion 73 at a position rearward of the imaginary line M. Without the angled surface 74, when the head portion 15*a* of the guide pin 15 is positioned in the lower portion 73 (i.e., when the inclination angle of the swash plate 12 is minimum as shown in FIG. 4), the head portion 15*a* would contact the wall of the guide hole 70 at a location indicated by the imaginary line M. With the cutaway surface 74, however, when the head portion 15*a* of the guide pin 15 is positioned in the lower region of the guide hole 70, the front portion of the head portion 15*a* contacts the wall of the guide hole 70 in the lower portion 73,and the rear half of the head portion 15*a* contacts nothing. Further, a given clearance is secured between the head portion 15*a* and the cutaway surface 74 on the rear side of the imaginary line M. This clearance prevents the guide pin 15 from interfering with the lower portion 73 of the support arm 14 when the inclination angle of the swash plate 12 is minimized. Therefore, the guide pin 15 and the swash plate 12 can move toward the cylinder block 1. The clearance is set so that the minimum clearance C2 (as measured along a line parallel to the axis L1) is equal to or greater than the top clearance C1 of the piston 18. That is, since C1≦C2, when the guide pin 15 and the swash plate 12 move toward the cylinder block 1, the guide pin 15 and the lower portion 73 of the associated support arm 14 are prevented from interfering with each other until the end face of the piston 18 contacts the valve plate 3.

As apparent from the above, the cooperation of the support arms 14 and guide pins 15 of the coupling mechanism allows the swash plate 12 to rotate integrally with the lug plate 11 and the drive shaft 6 and to tilt with respect to the drive shaft 6 while sliding on and along the drive shaft 6. In addition, when the inclination angle of the swash plate 12 is minimized (see FIG. 4), the rear portion of the guide pin 15 does not interfere with the inner surface of the corresponding socket. Therefore, the guide pin 15 and the swash plate 12 are permitted to move further toward the cylinder block 1 in the direction of the axis L1 of the drive shaft 6. When such movement takes place, the guide pin 15 does not pull the support arm 14. When the inclination angle of the swash plate 12 increases again from the minimum inclination angle, the guide hole 70 allows the guide pin 15 to slide and move upward along the axis L2 of the guide hole 70.

Figure 15:
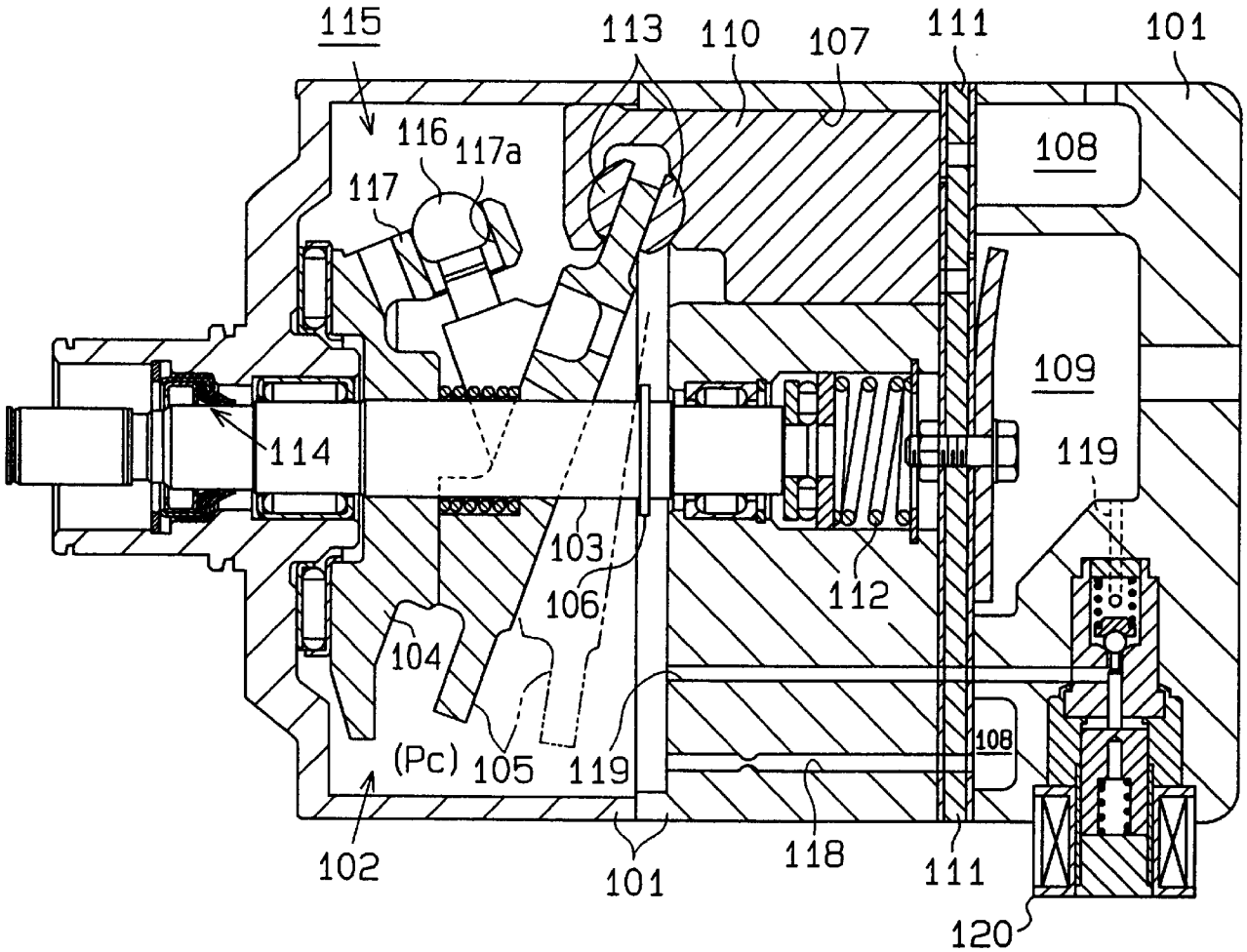
Fig.15 (Prior Art)
FIG. 15 is a longitudinal cross-sectional view showing a conventional variable displacement type swash plate compressor.

The following describes how a compressor equipped with the above-described coupling mechanism overcomes the problems of the prior art (FIG. 15).

The temperature of the vehicle passenger compartment may be set higher at the temperature setting unit 66 while the compressor is running at the maximum discharge displacement (at the maximum inclination angle of the swash plate). Further, the engine speed that is detected by the engine speed sensor 67 may increase abruptly due to sudden depression of the accelerator. In these cases, the computer C deexcites the solenoid 54 of the displacement control valve 50 to minimize the discharge displacement of the compressor. When the air-conditioning system is switched off or the engine E is stopped, the computer C likewise deexcites the solenoid 54 of the displacement control valve 50. As mentioned, the deexcitation of the solenoid 54 opens the valve hole 52 of the control valve 50 to rapidly increase the opening size of the supply passage 28 so that the high-pressure refrigerant gas in the discharge chamber 22 swiftly flows into the crank chamber 5. At this time, the flow rate of refrigerant gas through the bleed passage 27 is relatively small. Therefore, the crank pressure Pc abruptly increases. As a result, the difference between the crank pressure Pc and the cylinder-bore pressure increases, which minimizes the inclination angle of the swash plate 12.

If the difference between the crank pressure Pc and the cylinder-bore pressure is still great after the inclination angle of the swash plate 12 has reached the minimum inclination angle θmin, the pistons 18 are moved toward the valve plate 3. Accordingly, the swash plate 12 is pulled in a rearward axial direction. When the swash plate 12 is at the minimum inclination angle, the cutaway surfaces 74 formed on the sockets of the support arms 14 provide the minimum clearances C2 so that the guide pin 15 and the support arm 14 do not interfere with each other. This permits the pistons 18, the shoes 19, the swash plate 12 and the guide pins 15, which are integrated into one assembly, to independently move axially rearward. When the end face of at least one piston 18 contacts the valve plate 3, the further movement of the integral assembly is mechanically restricted. Because each guide pin 15 and the associated support arm 14 do not interfere with each other during the disinclination movement, the swash plate 12 does not pull the lug plate 11 and the drive shaft 6 rearward through the hinge mechanism 13. Even if the difference between the crank pressure Pc and the cylinder-bore pressure is relatively large, therefore, the lug plate 11 and the drive shaft 6 remain at the proper axial position, which is determined by the spring 7.

Thereafter, as the difference between the crank pressure Pc and the cylinder-bore inner pressure gradually decreases, the force of the return spring 17 affects the positioning of the swash plate 12. Finally, while being influenced by the moment caused by the difference between the crank pressure Pc and the cylinder-bore inner pressure, the force of the return spring 17 and the force of the spring 16 to reduce the inclination angle of the swash plate 12, the inclination angle θ of the swash plate 12 gradually converges to near the minimum inclination angle θmin (or an intermediate angle between the minimum inclination angle θmin and the maximum inclination angle θmax depending on the operational state of the compressor).

When disinclining, the swash plate 12 is disengaged from the walls of guide holes 70 and becomes unstable in the axial direction. When the swash plate 12 is pushed back forward influenced by the return spring 17 and its inclination angle becomes equal to or greater than the minimum inclination angle θmin, however, the spherical head portion 15*a* of each guide pin 15 reaches the boundary between the middle portion 72 and the lower portion 73 of the corresponding socket while being guided a long the angled cutaway surface 74. Therefore, the head portion 15*a* of each guide pin 15 is smoothly be engaged again with the annular middle portion 72.

As described above, this embodiment has the following advantages.

(1) According to this embodiment, even if the difference between the crank pressure Pc and the cylinder-bore inner pressure is excessive when the inclination angle of the swash plate 12 is a minimized, the pistons 18 and the swash plate 12 independently move axially backward, so that the lug plate 11 and the drive shaft 6 are not simultaneously pulled through the hinge mechanism 13. That is, the lug plate 11 and the drive shaft 6 remain at the proper axial position without being affected by the forward motion of the pistons 18 and the swash plate 12 that results from the excessive differential pressure. Even when the control valve 50 is abruptly and widely opened to rapidly increase the crank pressure Pc, therefore, the sliding position of the lip ring 34 of the lip seal 33 on the drive shaft 6 does not move significantly from the predetermined contact line. Thus, the lip seal 33 maintains the airtightness of the crank chamber 5 over a long period of time. Since the axial position of the drive shaft 6 is stable, the life of the lip seal 33 is extended, which extends the life of the compressor.

(2) Even when an excessive differential pressure is produced, the axial position of the drive shaft 6 is always stable. When the two clutch plates (the end face of the pulley 42 and the armature 45) of the electromagnetic clutch 40 are separated, therefore, a predetermined clearance always exists between them. Regardless of the state of the compressor, therefore, normal operation of the electromagnetic clutch 40 is guaranteed. That is, Problem 2 mentioned in the background section of this application is avoided.

(3) The upper portions 71 and the middle portions 72 of the annular sockets have the same structures as those of the prior art. Specifically, the upper portion 71, like that of the prior art, contacts the entire the head portion 15*a* of the guide pin 15 when the inclination angle of the swash plate 12 is maximized, and the middle portion 72 contacts the entire the head portion 15*a* when the swash plate 12 has an intermediate inclination angle. Therefore, the swash plate 12 is stable and the inclination angle θ is stable when the angle of the swash plate 12 is maximized or intermediate. When the inclination angle of the swash plate 12 is maximum and intermediate, the swash plate 12 is stably held by the hinge mechanism 13. It is therefore possible to prevent elimination of the clearance C1, which would result in continual striking of the pistons 18 against the valve plate 3. While it is the pistons may strike the valve plates when the inclination angle of the swash plate 12 is a minimized in this embodiment, the piston stroke is also minimized, so that if it occurs, would not break the valve plate 3.

(4) The cutaway surface 74 formed in the lower portion 73 of the sockets is angled to guide the head portion 15*a* of the guide pin 15 to the middle portion 72 when the swash plate inclines. After the swash plate 12 disinclines and the pins 15 disengage from the walls of the guide holes 70, therefore, the pins 15 are smoothly and positively engaged again with the sockets (particularly, the middle portions 72) of the support arms 14.

(5) In the compressor of this embodiment, unlike the prior art (FIG. 15), no stop member for mechanically stopping the disinclination of the swash plate 12 (and further reduction of the inclination angle) is located on the drive shaft 6. This also allows the pistons 18 and the swash plate 12 to independently move axially without pulling the drive shaft 6.

(6) In the variable displacement type compressor of this embodiment, the spring that suppresses motion of the drive shaft toward the valve plate and urges the drive shaft forward is located at the rear end of the drive shaft. This invention is adapted to such a compressor. In a compressor that determines the thrust position of the drive shaft in the housing by using such a spring, the drive shaft is likely to shift axially depending on inner or external factors. For such a compressor, therefore, it is advantageous if the coupling mechanism allows the swash plate to move backwards without interference.

(7) The variable displacement type compressor according to this embodiment has a supply passage, which connects the discharge pressure area to the crank chamber, and a displacement control valve to adjust the opening size of the supply passage. The displacement control valve is an input-side external control valve capable of externally controlling the flow rate of a high-pressure gas supplied to the crank chamber from the discharge pressure area and can rapidly raise the pressure of the crank chamber depending on how the external control is implemented. A variable displacement type compressor equipped with such an input-side external control valve is likely to have the problem of axial drive shaft movement. It is therefore advantageous if the coupling mechanism permits the swash plate to move backwards without interference.

Although only one embodiment of the present invention has been described herein, it should be apparent to those skilled in the art that the present invention may be embodied in many other specific forms without departing from the spirit or scope of the invention. Particularly, it should be understood that the invention may be embodied in the following forms.

The embodiment of this invention may be modified as follows.

Figure 6:
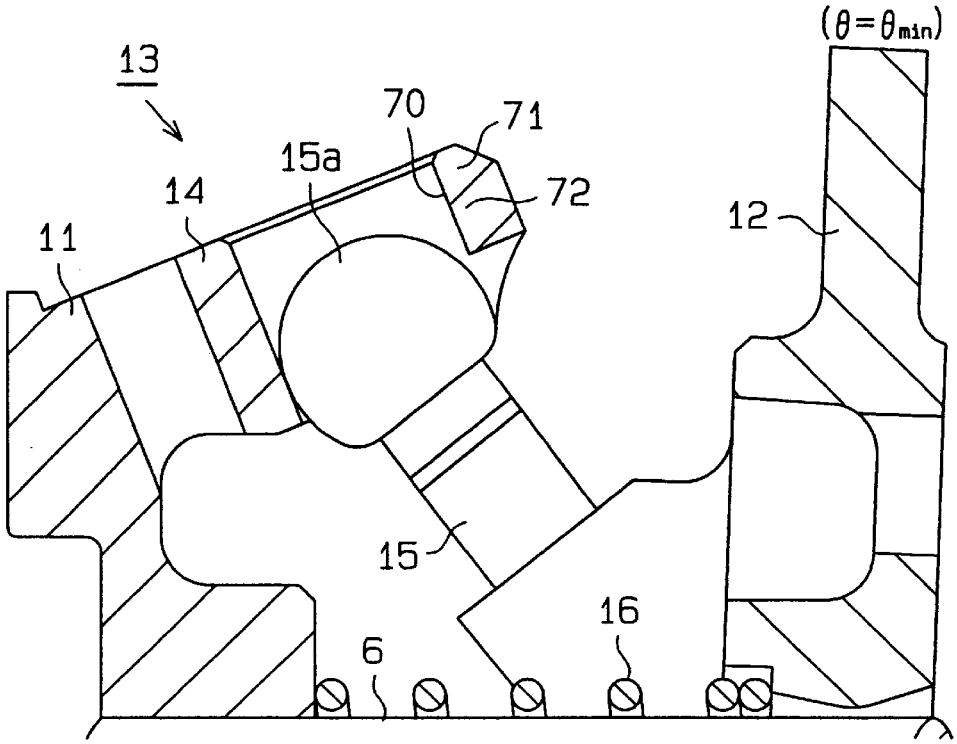
FIG. 6 is a cross-sectional view FIG. 4 showing a coupling mechanism according to another embodiment of the invention.

(1) As shown in FIG. 6, the rear wall of the annular socket that defines the guide hole 70 may include only the upper portion 71 and the middle thick portion 72. That is the lower portion 73 can be removed entirely. This prevents contact between the pins 15 and the sockets when the swash plate 12 disinclines in the proximity of the minimum inclination angle. This structure therefore has the same advantages of the first embodiment.

Figure 7:
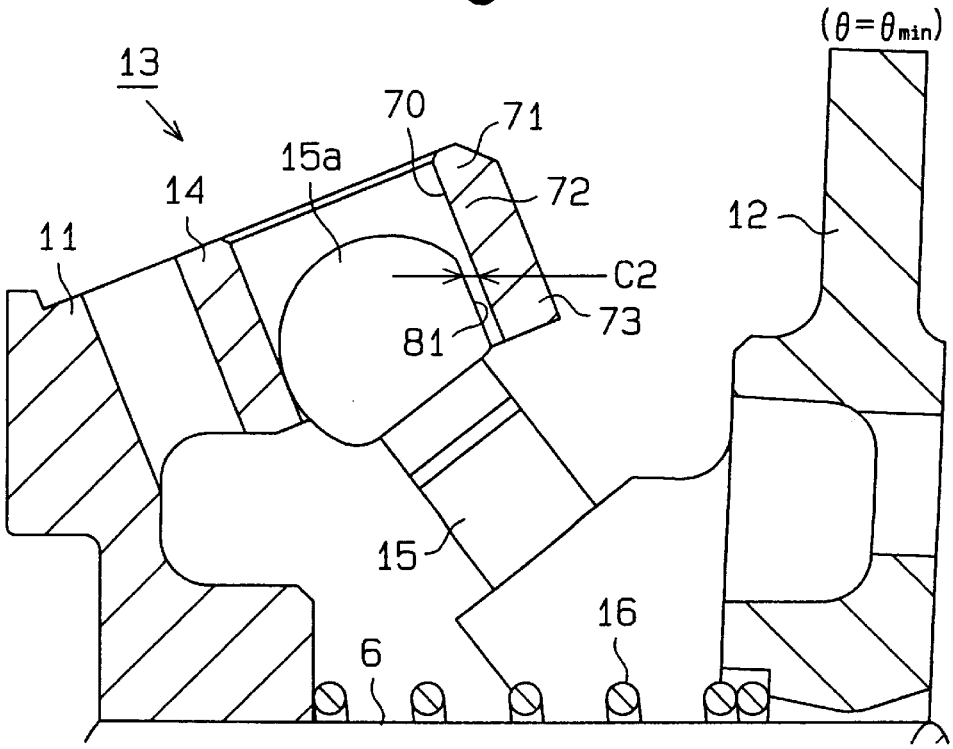
FIG. 7 is a cross-sectional view like FIG. 4 showing a coupling mechanism according to yet another embodiment of the invention.

(2) As shown in FIG. 7, the cutaway surfaces 74 are not formed on the lower portion 73 of the rear portion of the annular sockets and the wall thickness of the lower portion 73 is nearly equal to that of the middle portion 72. Instead, an outer cut-away surface 81 is formed by removing a rear section of the head portion 15*a* of the guide pin 15 as shown. This produces the predetermined clearance C2 between the rear cut-away surface 81 and the rear wall of the lower portion 73. This structure also has the same advantages of the first embodiment.

Figure 8:
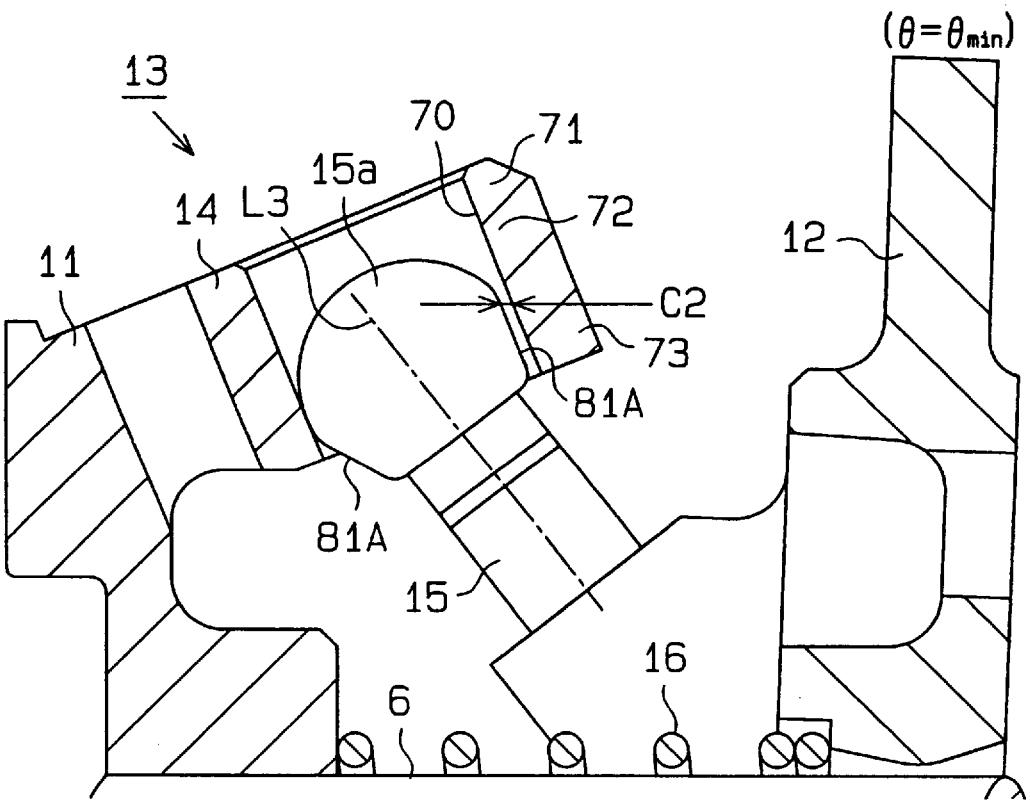
FIG. 8 is a cross-sectional view like FIG. 4 showing a coupling mechanism according to yet another embodiment of the invention.

(3) In the modification of FIG. 7, the outer surface 81 is formed by cutting off a rear section of the head portion 15*a* of the guide pin 15. As an alternative, as shown in FIG. 8, a conical surface 81A extending all around the head portion 15*a* of the guide pin 15 may be formed by tapering a portion of the head portion 15*a*. In this case, the predetermined clearance C2 is produced between the rear side of the conical surface 81A and the rear surface of the lower portion 73 when the swash plate 12 is at or near the minimum inclination angle. This structure likewise has same advantages of the first embodiment. In addition, since the head portion 15*a* of FIG. 8 is round in cross section, it is unnecessary to consider the angular position of the guide pin 15 during assembly.

Figure 9:
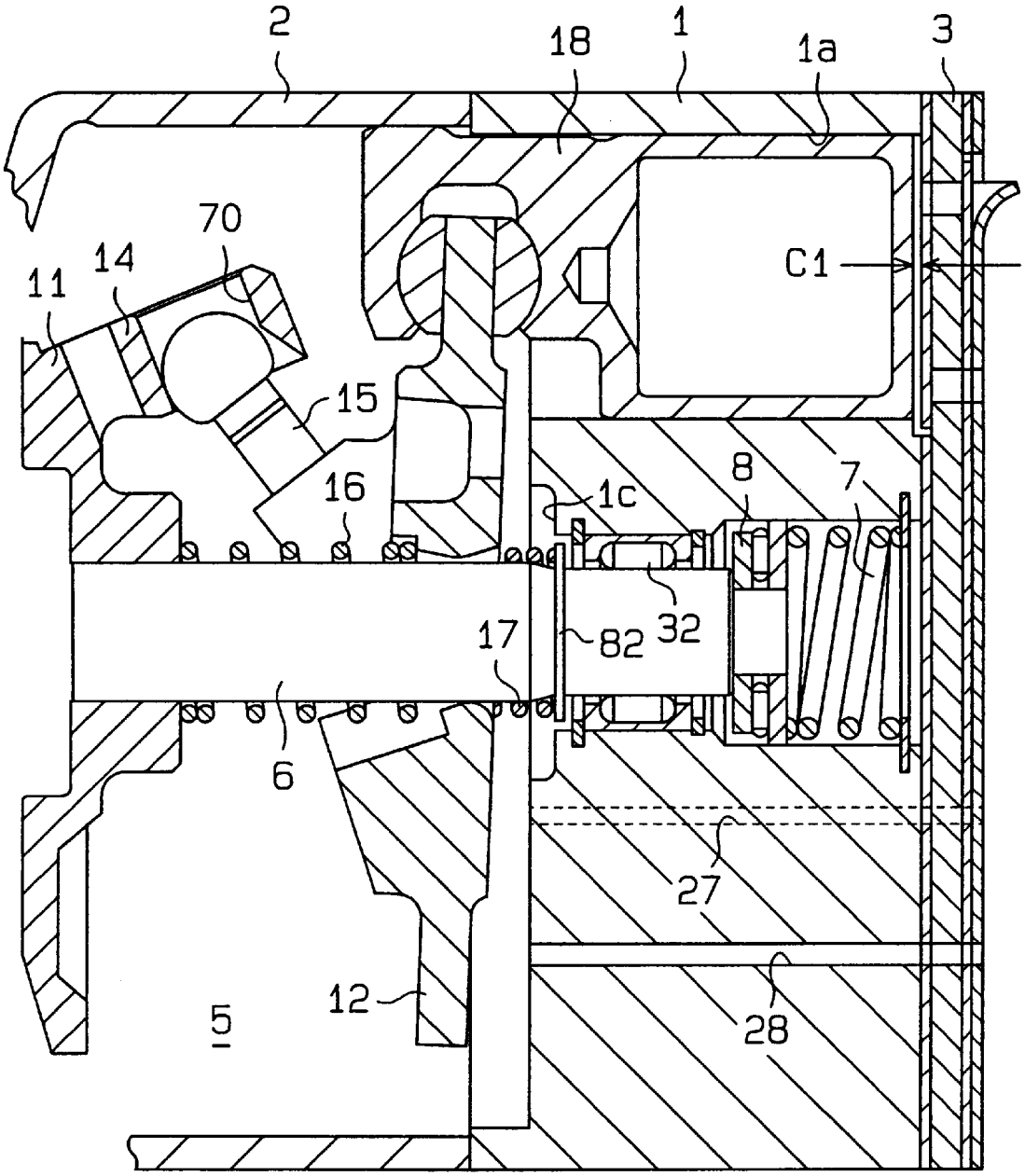
FIG. 9 is a cross-sectional view of the compressor depicting a variation of the structure that restricts the retraction of a return spring.

(4) The rear end of the return spring 17 is supported by the front end face 1*c* of the cylinder block 1 when the swash plate 12 is at the minimum inclination in the first embodiment (FIGS. 1 to 5). As shown in FIG. 9, however, the rear end of the return spring 17 may be supported by a restriction ring 82 such as a snap ring secured to the drive shaft 6 when the swash plate 12 is at the minimum inclination angle. More specifically, the return spring 17 is provided on the drive shaft 6 between the swash plate 12 and the restriction ring 82. When the swash plate 12 has a large inclination angle, the return spring 17 is simply wound around the drive shaft 6 and does not apply any force to the swash plate 12 or any other member. When the inclination angle of the swash plate 12 decreases as shown in FIG. 9, on the other hand, the return spring 17 is compressed between the swash plate 12 and the restriction ring 82, which urges the swash plate 12 in the direction of greater inclination in accordance with the degree of the compression of the spring, and the restriction ring 82 serves as the support seat. The natural length of the return spring 17 and the position of the restriction ring 82 are set so that the return spring 17 is not compressed all the way even when the swash plate 12 reaches the minimum inclination angle θmin (ranging between 1 and 5°) when the compressor is in operation. Further, the compressor is designed such that even when the swash plate 12 disinclines beyond the designed minimum inclination angle, the top end of the pistons 18 contact the valve plate 3 before the return spring 17 is fully compressed so that no further disinclination of the swash plate 12 is possible. Even if the restriction ring 82 is fixed on the drive shaft 6 as shown in FIG. 9, therefore, this modification does not have the same shortcoming of the restriction ring 106 of the prior art (FIG. 15). When the inclination angle of the swash plate 12 is minimized, the spring 16, which reduces the inclination angle of the swash plate 12, is almost fully extended and hardly influences the swash plate 12. What is more, the spring constant of the return spring 17 is considerably smaller than the spring constant of the spring 7 that urges the drive shaft 6 forward. Therefore, the force (the reactive force) of the return spring 17 that is transmitted to the drive shaft 6 through the restriction ring 82 does not exceed the forward force of the spring 7, and the drive shaft 6 does not shift axially.

Even if the difference between the crank pressure Pc and the cylinder-bore pressure is high when the inclination angle of the swash plate 12 has reached the minimum inclination angle θmin, the pistons 18, the shoes 19, the swash plate 12 and the guide pins 15 as an integral assembly can move independently in the axial direction until the end faces of the pistons 18 contact the valve plate 3. Therefore, the lug plate 11 and the drive shaft 6 are not pulled back through the hinge mechanism 13. Even if the differential pressure is excessive, therefore, the lug plate 11 and the drive shaft 6 are urged forward by the spring 7 and remain at the proper axial position, which is determined by the spring 7. When the pressure Pc of the crank chamber 5 and the cylinder-bore pressure are the same, the inclination angle θ of the swash plate 12 eventually lies between the minimum inclination angle θmin and the maximum inclination angle θmax based on the balance of the force of the return spring 17 and the force of the spring 16 that reduces the inclination angle of the swash plate 12.

Figure 10:
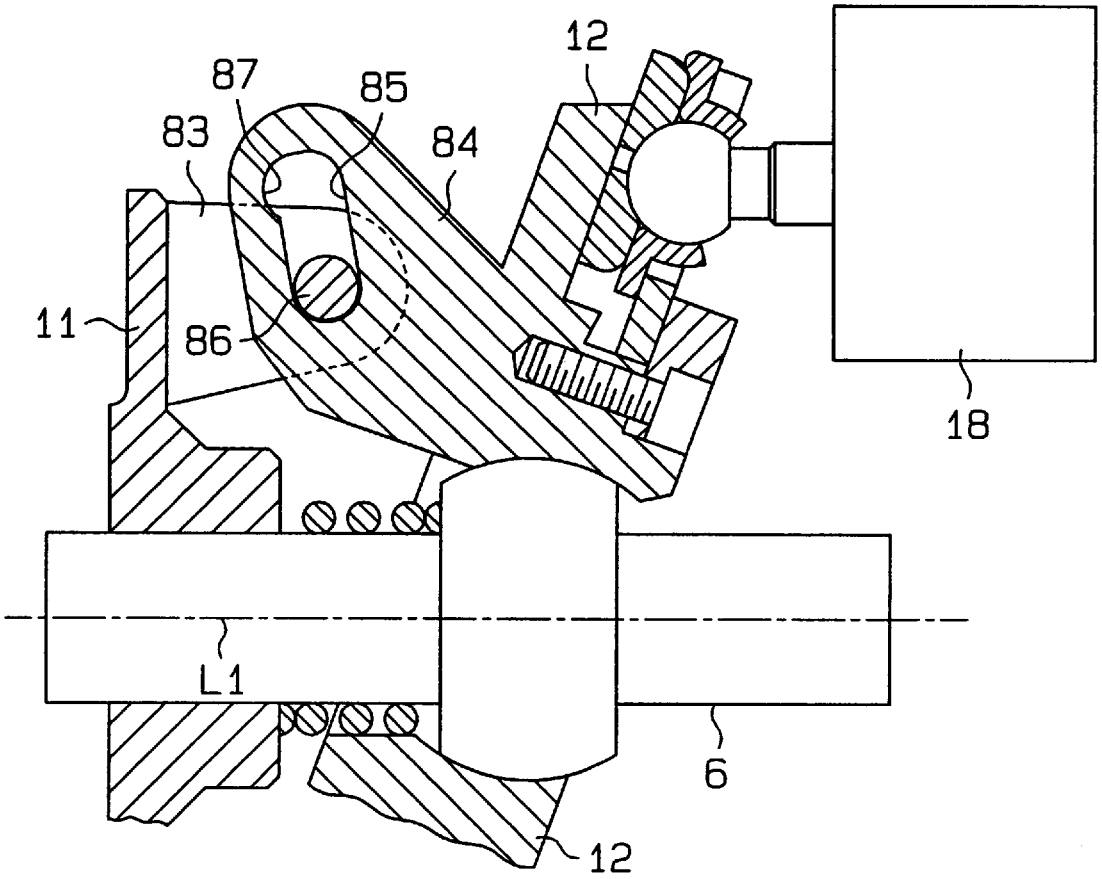
FIG. 10 is a cross-sectional view like FIG. 3 showing a coupling mechanism according to another embodiment of the invention.

(5) This invention includes a coupling mechanism as shown in FIG. 10. The coupling mechanism in FIG. 10 includes the lug plate 11, which is secured to the drive shaft 6, a pair of (right and left) outer arms 83 (only one shown) protruding from the rear face of the lug plate 11 and an inner arm 84, which extends from the front face of a wobble-type swash plate 12.

The inner arm 84 is located between the outer arms 83 and has a guide hole 85 is shown. A link pin 86, which links outer arms 83 to the inner arm 84 is fitted in the guide hole 85. Since the link pin 86 is movable along the guide hole 85, the inclination and motion of the swash plate 12 are guided. When the link pin 86 is at the lower end of the guide hole 85, as shown in FIG. 10, the swash plate 12 is fully inclined. When the link pin 86 is at the upper end position of the guide hole 85, on the other hand, the swash plate 12 is minimally inclined. A cutaway portion 87 is formed in the inner arm 84 near the upper end of the guide hole 85. The cutaway portion 87, like the cutaway surface 74 in the first embodiment, provides a predetermined clearance to permit the inner arm 84, the swash plate 12 and the pistons 18 to integrally and independently move toward the cylinder block when the difference between the crank pressure and the cylinder-bore inner pressure is excessive. This prevents the second arm 84 from pulling the outer arms 83, the lug plate 11 and the drive shaft 6 rearward. This structure therefore has the advantages of the first embodiment.

(6) Although the cutaway portion 87 is formed adjacent to the guide hole 85 in FIG. 10, the front side of the link pin 86 may be cut off based on the principle used in FIG. 7 instead of providing the cutaway portion 87. A clearance between the pin 86 and the inner arm 84 may be formed between the face produced by cutting away the front side of the link pin 86 and the inner edge of the guide hole 85.

Figure 11:
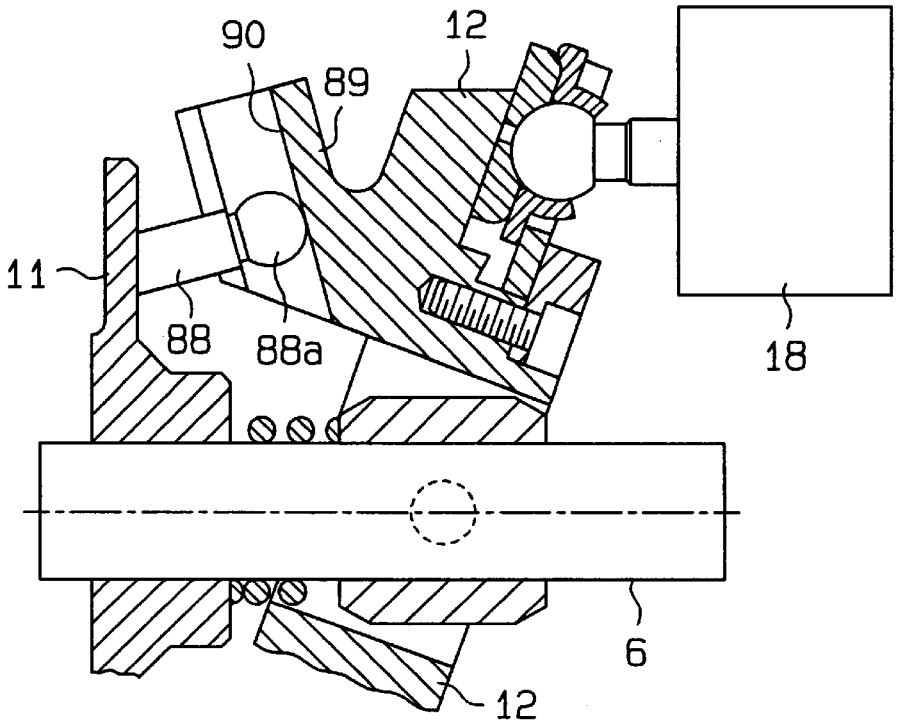
FIG. 11 is a cross-sectional view like FIG. 3 showing a coupling mechanism according to another embodiment of the invention.
Figure 12:
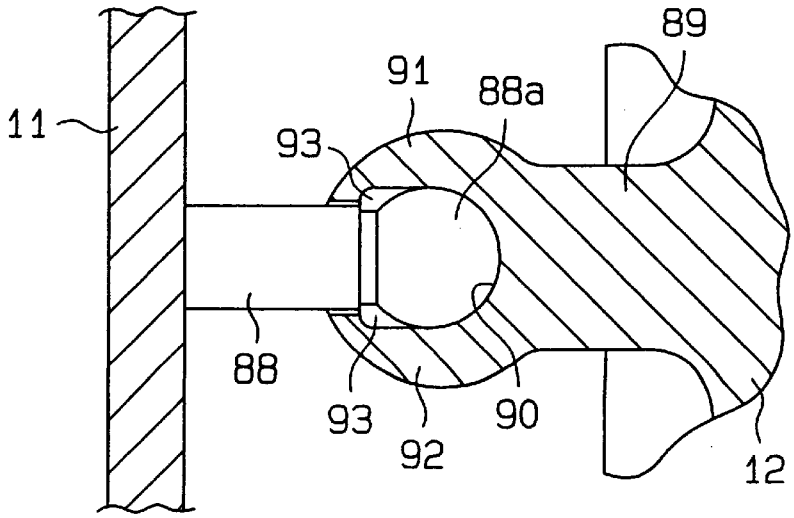
FIG. 12 is a horizontal cross-sectional view showing the essential parts of the coupling mechanism of FIG. 11.

(7) The invention includes a coupling mechanism as shown in FIGS. 11 and 12. The coupling mechanism in FIGS. 11 and 12 includes the lug plate 11, which secured to the drive shaft 6, a rod 88, which protrudes from the rear face of the lug plate 11, and an arm 89, which protrudes from the front face of a wobble-type swash plate 12. A spherical head portion 88*a* is formed at the distal end of the rod 88. Formed in the arm 89 is a guide hole or guide groove 90 which extends upward and forward as shown in FIG. 11. The spherical head 88*a* of the rod 88 engages the walls of the guide groove 90. As the rod 88 is moves along the guide groove 90, the inclination and motion of the swash plate 12 are guided. When the spherical head portion 88*a* of the rod 88 is located near the lower end of the guide groove 90, as shown in FIG. 11, the swash plate 12 has fully inclined. When the spherical head portion 88*a* is near the upper end of the guide groove 90, on the other hand, the swash plate 12 is minimally inclined. As shown in FIG. 12, the guide groove 90 is defined by a pair of walls 91 and 92 of the arm 89. As shown in FIG. 12, spaces 93, 93 are formed by the walls 91 and 92 in the vicinity of the upper end of the guide groove 90. When the spherical head portion 88*a* of the rod 88 is in the vicinity of the upper end of the guide groove 90, the spaces 93, 93 provide clearances between the front side of the spherical head portion 88*a* and the walls 91 and 92. Like the clearance C2 in the first embodiment, the clearances C2 permit the arm 89, the swash plate 12 and the pistons 18 to integrally and independently move toward the cylinder block. This prevents the arm 89 from pulling the rod 88, the lug plate 11 and the drive shaft 6 rearward when the difference between the crank pressure and the cylinder-bore inner pressure is excessive. Therefore, the structure in FIGS. 11 and 12 likewise has the advantages of the embodiment.

Figure 13:
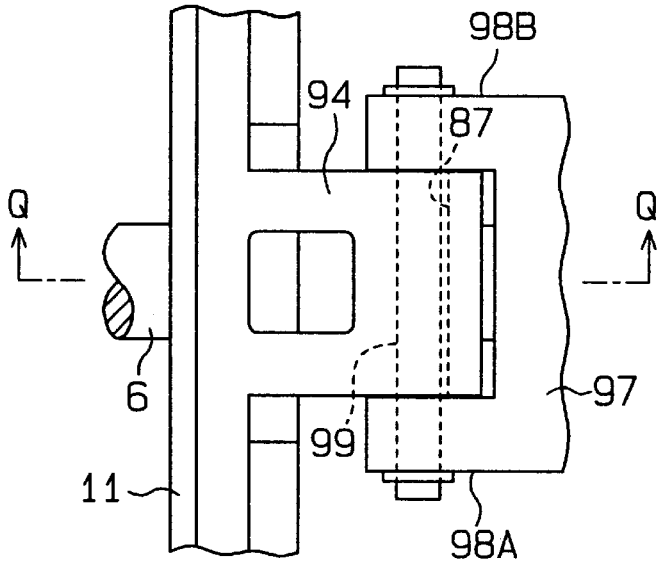
FIG. 13 is a partial plan view depicting a coupling mechanism according to another embodiment of the invention.
Figure 14:
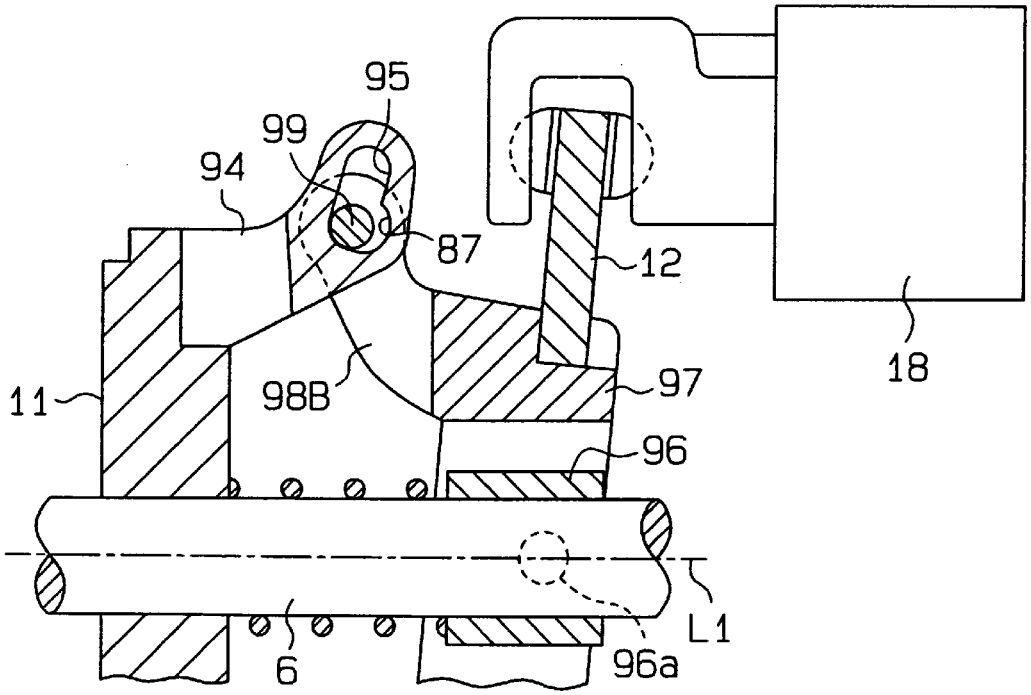
FIG. 14 is a cross-sectional view like FIG. 4 taken along the line Q—Q in FIG. 13.

(8) The invention includes a coupling mechanism as shown in FIGS. 13 and 14. Two outer arms 94 extend from the rear face of the lug plate 11, and the distal ends of the outer arms are joined. A guide hole 95 is formed in the joined portion of the outer arms 94. A sleeve 96 is provided to slide axially on the drive shaft 6. A pair of support pins 96*a* (only one shown by a broken line) are fixed to the respective sides of the sleeve 96. A tilting body 97 is located around the sleeve 96, and the swash plate 12 is secured to the outer surface of the tilting body 97. The tilting body 97 and swash plate 12 constitute a cam plate, which is pivotally supported by the support pins 96*a* of the sleeve 96. A pair of inner arms 98A and 98B extend from the front side of the tilting body 97, and their distal ends sandwich the linked portion of the inner arms 94. A link pin 99 extends between the distal ends of the outer arms 98A and 98B and engages the inner surface of the guide hole 95 of the arms 94. As the link pin 99 is moves along the guide hole 95, the swash plate 12 tilts with respect to the drive shaft 6 while sliding along the drive shaft 6. As shown in FIG. 14, when the link pin 99 is at the lower end of the guide hole 95, the inclination angle of the swash plate 12 is small. A cutaway portion 87 is formed in the inner arms 94, adjacent to the lower end of the guide hole 95. The cutaway portion 87, like the cutaway surface 74 in the first embodiment, provides a predetermined clearance to permit the link arms 98A and 98B, the cam plate and the pistons 18 to independently move toward the cylinder block when the difference between the crank pressure and the cylinder-bore pressure is excessive. This prevents the link pin 99 and the link arms 98A and 98B from pulling the support arms 94, the lug plate 11 and the drive shaft 6 rearward. Therefore, this structure has the advantages of the first embodiment.

Therefore, the present examples and embodiments are to be considered as illustrative and not restrictive and the invention is not to be limited to the details given herein, but may be modified within the scope and equivalence of the appended claims.

What is claimed is:

1. A variable displacement type compressor comprising:

a crank chamber;

a drive shaft rotatably supported in the crank chamber;

pistons for performing a compressing operation;

a cam plate, located in the crank chamber and coupled to the pistons for converting rotation of drive shaft to a reciprocal motion of the pistons, the stroke of which depends on the inclination angle of said cam plate, which varies according to the pressure in said crank chamber; and a coupling mechanism for coupling the cam plate to the drive shaft, the coupling mechanism including:

a rotary support that rotates integrally with the drive shaft;

a first engaging surface provided on the rotary support; and a second engaging surface provided on the cam plate, wherein the first engaging surface and the second engaging surface engage and couple the cam plate to the rotary support to permit said inclination of the cam plate with respect to said drive shaft, wherein at least one of the first engaging surface and the second engaging surface has a predetermined shape that causes the first engaging surface to separate and disengage from the second engaging surface when the inclination angle of said cam plate is at or near a minimum.

2. The variable displacement type compressor according to claim 1, wherein the coupling mechanism allows a top clearance of the pistons to become zero when the inclination angle of the cam plate is minimized.

3. The variable displacement type compressor according to claim 1, wherein the coupling mechanism does not transmit the pressure in the crank chamber acting on the pistons to the drive shaft when the inclination angle of the cam plate is minimized.

4. The variable displacement type compressor according to claim 1, wherein said first engaging surface is part of a socket, which includes a cylindrical guide hole, and the second engaging surface is part of a spherical portion that fits into the guide hole, wherein the predetermined shape is a cutaway portion formed in the socket and intersects the guide hole, the predetermined shape being located at a location where the spherical portion is located when the inclination angle of the cam plate is minimized, and the predetermined shape is opposite to the rotary support with respect to the spherical portion.

5. The variable displacement type compressor according to claim 4, wherein the inside diameter of the guide hole at a location apart from the cutaway portion is substantially equal to the maximum diameter of the spherical portion.

6. The variable displacement type compressor according to claim 1, wherein the first engaging surface is a socket having a cylindrical guide hole, and the second engaging surface is a spherical inserting portion that fits in the guide hole, and the predetermined shape is a cutaway portion formed on a side of the spherical portion that faces away from the rotary support.

7. The variable displacement type compressor according to claim 1, wherein the first engaging surface is on a socket having a cylindrical guide hole, and the second engaging surface is on a spherical portion that fits in the guide hole, wherein the predetermined shape is a cutaway portion formed in an entire surface of the spherical portion, wherein the shape of the spherical portion is constant about an axis passing through the center of the spherical portion.

8. The variable displacement type compressor according to claim 6, wherein the inside diameter of the guide hole is substantially equal to the maximum diameter of the spherical portion.

9. The variable displacement type compressor according to claim 1, further comprising a return spring for urging the cam plate in a direction to increase inclination angle of cam plate when said inclination angle of the cam plate is small.

10. The variable displacement type compressor according to claim 4, wherein a clearance is formed between the spherical portion and the surface of the guide hole by the predetermined shape when the inclination angle of the cam plate is minimized, and the clearance is equal to or greater than a top clearance of the pistons.

11. The variable displacement type compressor according to claim 1, wherein the second engaging surface is located on a holder having a guide hole, the first engaging surface is a rod-like structure that fits into the guide hole, and the predetermined shape is formed in an inner surface of the guide hole at a location where the first engaging surface is located when the inclination angle of the cam plate is minimized, and the predetermined shape is located between the rod-like structure and the rotary support.

12. The variable displacement type compressor according to claim 1, wherein the second engaging surface is a socket having a guide groove, the first engaging surface is a spherical portion that fits in the guide groove, the predetermined shape is an enlargement of the groove and the enlargement is formed at a location where the first engaging surface is located when said inclination angle of said cam plate is a minimized, and the enlargement creates a space between the spherical portion and the rotary support.

13. A variable displacement type compressor comprising:

a crank chamber;

a drive shaft rotatably supported in the crank chamber;

pistons for performing a compressing operation;

a cam plate, located in the crank chamber and coupled to the pistons for converting rotation of drive shaft to a reciprocal motion of the pistons, the stroke of which depends on the inclination angle of said cam plate, which varies according to the pressure in said crank chamber; and a coupling mechanism for coupling the cam plate to the drive shaft so that the cam plate rotates integrally with the drive shaft and the angle of said cam plate varies with respect to the drive shaft, the coupling mechanism including:

a lug plate that rotates integrally with the drive shaft;

a support arm provided on said lug plate, the support arm having a cylindrical guide hole;

a guide pin provided on said cam plate, the guide pin having a spherical head that fits in the guide hole; and a cutaway surface formed to adjoin an inner surface of said guide hole at a location where the head of the guide pin is located when the inclination angle of said cam plate is minimized, the cutaway surface being opposite to the lug plate with respect to the head.

14. The variable displacement type compressor according to claim 13, wherein the diameter of the guide hole apart from the cutaway surface is substantially equal to the maximum diameter of the head.

15. The variable displacement type compressor according to claim 13, further comprising a return spring for urging the cam plate in a direction to increase the inclination angle of the cam plate when said inclination angle of the cam plate is small.

16. The variable displacement type compressor according to claim 14, wherein a clearance is formed between said head of said guide pin and said inner surface of said guide hole by said cutaway surface when the inclination angle of the cam plate is minimized, and the clearance is equal to or greater than a top clearance of the pistons.

* * * * *